US010399735B2

(12) United States Patent
Yuasa

(10) Patent No.: US 10,399,735 B2
(45) Date of Patent: Sep. 3, 2019

(54) ASSEMBLY-TYPE PACKAGING BOX

(71) Applicant: AUDIO-TECHNICA CORPORATION, Machida-shi, Tokyo (JP)

(72) Inventor: Hiroyuki Yuasa, Machida (JP)

(73) Assignee: AUDIO-TECHNICA CORPORATION, Machida-Shi, Tokyo (JP)

( * ) Notice: Subject to any disclaimer, the term of this patent is extended or adjusted under 35 U.S.C. 154(b) by 0 days.

(21) Appl. No.: 15/793,298

(22) Filed: Oct. 25, 2017

(65) Prior Publication Data

US 2018/0134442 A1 May 17, 2018

(30) Foreign Application Priority Data

Nov. 11, 2016 (JP) ..... 2016-220582

(51) Int. Cl.
*B65D 5/22* (2006.01)
*B65D 5/42* (2006.01)
(Continued)

(52) U.S. Cl.
CPC ..... *B65D 5/4279* (2013.01); *B65D 5/22* (2013.01); *B65D 5/28* (2013.01); *B65D 5/6655* (2013.01); *B65D 5/6664* (2013.01); *B65D 5/4266* (2013.01)

(58) Field of Classification Search
CPC ..... B65D 5/4279; B65D 5/22; B65D 5/28; B65D 5/6655; B65D 5/6664; B65D 5/4266; B65D 5/4283
See application file for complete search history.

(56) References Cited

U.S. PATENT DOCUMENTS 2,439,959 A * 4/1948 Anderson, Jr. ..... B65D 5/22 229/117.21
2,707,587 A * 5/1955 Wittstein ..... B65D 5/22 229/125.19

(Continued)

FOREIGN PATENT DOCUMENTS

JP 2005-145525 A 6/2005
JP 2014-133580 A 7/2014

OTHER PUBLICATIONS

Europe Patent Office, "Search Report for European Patent Application No. 17198490.9," dated Mar. 16, 2018.

*Primary Examiner* — Derek J Battisti
(74) *Attorney, Agent, or Firm* — Manabu Kanesaka

(57) ABSTRACT

An assembly-type packaging box is configured by erecting a front and rear panel along valley fold lines respectively in front of and behind a bottom panel; then folding outer panels, upper-edge panels, and inner panels, such that rear folding tabs extending from a side of the rear panel are folded in between the outer and inner panel. This allows the upper-edge panels to form a frame having a predetermined width at an opening portion. Folding protrusions, which fix positions of the upper-edge panels forming the frame by abutting on the rear folding tabs folded in between each of the outer panels and each of the inner panels, are formed on sides of the inner panels. With this configuration, the box allows to prevent displacement of the upper-edge panel forming the frame and generation of a gap caused by the displacement of the upper-edge panel.

7 Claims, 7 Drawing Sheets

(51) Int. Cl.
*B65D 5/28* (2006.01)
*B65D 5/66* (2006.01)

(56) References Cited

U.S. PATENT DOCUMENTS

| | | | | | |
|---|---|---|---|---|---|
| 2,894,672 | A | | 7/1959 | Bamburg | |
| 3,642,193 | A | * | 2/1972 | Rada | B65D 5/22 229/146 |
| 3,910,484 | A | * | 10/1975 | Wozniacki | B65D 5/2047 229/171 |
| 5,375,702 | A | | 12/1994 | Fiallo | |
| 6,029,885 | A | * | 2/2000 | Mueller | B65D 5/22 229/125.19 |
| 6,938,820 | B2 | * | 9/2005 | Noone | B65D 5/0015 229/176 |
| 2004/0043881 | A1 | * | 3/2004 | Taylor | B65D 5/22 493/68 |
| 2017/0129639 | A1 | * | 5/2017 | Carden | B65D 5/22 |

* cited by examiner

ASSEMBLY-TYPE PACKAGING BOX

RELATED APPLICATIONS

The present application is based on, and claims priority from, Japanese Application No. JP2016-220582 filed Nov. 11, 2016, the disclosure of which is hereby incorporated by reference herein in its entirety.

BACKGROUND OF THE INVENTION

Field of the Invention

The present invention relates to an assembly-type packaging box whose appearance in an assembled state is a cuboid, for example, and particularly relates to improvement of an assembly-type packaging box in which an edge panel having a fixed width is formed in a frame shape at an opening edge of a box.

Description of the Related Art

Assembly-type packaging boxes, assembled folding thick paper, such as a sheet of synthetic paper and cardboard, or a thick resin sheet into a cuboid shape, have been widely used.

Various kinds of contrivances have been made to facilitate assembly and disassembly of this kind of assembly-type packaging box, and studies have been also conducted to increase rigidity and durability to a certain extent so as to prevent deformation during conveyance. In addition, there is also a proposal for an assembly-type packaging box in which an edge panel having a fixed width is formed in a frame shape at an opening edge of a box to further improve the external appearance, in order to achieve a balance between a value and quality of a product accommodated in the packaging box; and such a proposal is disclosed in JP 2005-145525 A (Patent Literature 1) and JP 2014-133580 A (Patent Literature 2).

FIGS. 13 and 14 illustrate examples of a packaging box having a frame-shaped opening edge disclosed in Patent Literature 1 and 2 so as to correspond to an embodiment of an assembly-type packaging box according to the present invention.

A configuration of the main part of the conventional packaging box illustrated in FIG. 13 and FIG. 14 is the same as that of the embodiment according to the present invention, which will be described later with reference to FIGS. 1 to 7, except for a part (right and left folding tabs). Accordingly, parts corresponding to those of the embodiment will be denoted by the same reference numerals, and a detailed description of the assembly-type packaging box will be described later with reference to FIGS. 1 to 7.

FIG. 13 is a plan view of a development sheet 10 illustrated in a state where the conventional assembly-type packaging box is developed, and FIG. 14 is an appearance view obtained by folding the development sheet 10 and forming an assembly-type packaging box 10A having a cuboid shape. Fold lines indicated by dashed lines drawn on the development sheet 10 illustrated in FIG. 13 are all valley fold lines of 90 degrees.

To assemble the assembly-type packaging box 10A illustrated in FIG. 14, with a bottom panel 11 of the development sheet 10 illustrated in FIG. 13 as the center, a front panel 12 and a rear panel 13 are folded into the state of being erected. Further, each of a left-front folding tab 14 and a right-front folding tab 15 connected to the front panel 12 is folded and, each of a left-rear folding tab 16 and a right-rear folding tab 17 connected to the rear panel 13 is folded in the same manner.

In this state, the left-front folding tab 14 and the left-rear folding tab 16 are connected by being fitted to each other such that connecting slits 14*a* and 16*a* provided on the left-front folding tab 14 and the left-rear folding tab 16, respectively, intersect each other vertically. Similarly, the right-front folding tab 15 and the right-rear folding tab 17 are connected by being fitted to each other such that connecting slits 15*a* and 17*a* provided on the right-front folding tab 15 and the right-rear folding tab 17, respectively, intersect each other vertically.

Subsequently, a left outer panel 18, a left upper-edge panel 19, and a left inner panel 20 are folded in order to insert a left locking protrusion 20*a* formed on the left inner panel 20 into a left locking hole 11*a*. Accordingly, the left outer panel 18, the left upper-edge panel 19 and the left inner panel 20 cover the left-front folding tab 14 and the left-rear folding tab 16 in the state of being crossed and connected to each other, and the left upper-edge panel 19 is formed as a frame member on the left side of the box so as to be positioned in a frame shape.

Similarly, a right outer panel 21, a right upper-edge panel 22, and a right inner panel 23 are folded in order to insert a right locking protrusion 23*a* formed on the right inner panel 23 into a right locking hole 11*b*. Accordingly, the right outer panel 21, the right upper-edge panel 22, and the right inner panel 23 cover the right-front folding tab 15 and the right-rear folding tab 17 in the state of being crossed and connected to each other, and the right upper-edge panel 22 is formed as a frame on the right side of the box so as to be positioned in a frame shape.

Further, a left top-panel inserting tab 25 and a right top-panel tab 26 are accommodated in the box by folding the left top-panel inserting tab 25 and the right top-panel inserting tab 26 with respect to an top panel 24 and folding the top panel 24 with respect to the rear panel 13, and a state where the left upper-edge panel 19 and the right upper-edge panel 22 are positioned on the right and left sides of the closed top panel 24 in a frame shape is formed.

Subsequently, each of the left front-panel inserting tab 28 and the right front-panel inserting tab 29 is folded with respect to the front panel 27, and the left front-panel inserting tab 28 is inserted into a gap between the left outer panel 18 and the left-front folding tab 14. Similarly, the right front-panel inserting tab 29 is inserted into a gap between the right outer panel 21 and the right front folding tab 15, whereby it is possible to assemble the cuboidal packaging box 10A illustrated in FIG. 14.

SUMMARY OF THE INVENTION

According to the packaging box 10A illustrated in FIG. 14 assembled in the above-described order, the left upper-edge panel 19 and the right upper-edge panel 22 are positioned on both sides of the closed top panel 24 in a frame shape, and thus, it is possible to provide the assembly-type packaging box capable of giving high-grade appearance with aligned style. In the packaging box 10A illustrated in FIG. 14, however, there is a problem that at the rear panel 13 side, gaps g1 and g2 are likely to occur between the top panel 24 and the left upper-edge panel 19 or the right upper-edge panel 22, each forming a left or right side of a frame.

When exemplifying the left upper-edge panel 19 constituting the frame on the left side, in addition to the left-front folding tab 14, the left front-panel inserting tab 28 is inserted between the left outer panel 18 and the left inner panel 20 connected to the left upper-edge panel 19. As a result the total thickness becomes a twice thickness corresponding to two tabs on the front side (the front cover panel 27 side) of the packaging box 10A. On the other hand, on the rear side (the rear panel 13 side) of the packaging box 10A, a thickness is corresponding to one sheet due to the left-rear folding tab 16 between the left outer panel 18 and the left inner panel 20.

Therefore, a larger space is formed under the left frame (indicated by the same reference numeral 19 as the left upper-edge panel) due to the less number of inserted panel, so that a rear side of the left frame 19 is easily displaced outward. As a result, the gap g1 is likely to occur between the left upper-edge panel 19 and the closed top panel 24.

This is a similar situation in a right frame (indicated by the same reference numeral 22 as the right upper-edge panel) formed by the right upper-edge panel 22, a rear side of the right frame 22 is easily displaced outward, and the gap g2 is likely to occur between the right upper-edge panel 22 and the closed top panel 24.

Therefore, the main problem that the present invention intends to solve is to provide an assembly-type packaging box that is capable of preventing displacement of the upper-edge panel forming the frame as illustrated in FIG. 14 in the assembled box in which the upper-edge panel is formed in a frame shape at the opening portion of the box, and of effectively preventing occurrence of the gaps g1 and g2 due to the displacement of the upper-edge panel without causing an increase in cost.

Hereinafter, an assembly-type packaging box according to the present invention will be described with reference numerals of the respective constituent elements illustrated in the drawings for each claim in order to clarify a relationship between each item described in the claims and each corresponding unit described in embodiments.

An assembly-type packaging box according to a first aspect of the present invention is an assembly-type packaging box obtained by erecting a front panel (12) and a rear panel (13) along valley fold lines respectively in front of and behind a bottom panel (11); sequentially folding outer panels (18 and 21), upper-edge panels (19 and 22), and inner panels (20 and 23), sequentially connected to right and left of the bottom panel (11) with valley fold lines, such that a rear folding tab (16 or 17) extending from a side of the rear panel (13) is folded in between the outer panel (18 or 21) and the inner panel (20 or 23), and the upper-edge panels (19 and 22) form a frame having a predetermined width at an opening portion of a box body. In the assembly-type packaging box, a folding protrusion (20*b* or 23*b*), which fixes a position of the upper-edge panel (19 or 22) by abutting on the rear folding tab (16 or 17) folded between the outer panel (18 or 21) and the inner panel (20 or 23), is formed on a side of the inner panel (20 or 23).

In the assembly-type packaging box according to a second aspect of the present invention, a front folding tab (14 or 15) extending from a side of the front panel (12) is formed on the front panel (12) to be folded between the outer panel (18 or 21) and the inner panel (20 or 23), and the front folding tab (14 or 15) and the rear folding tab (16 or 17) are connected within a space between the outer panel (18 or 21) and the inner panel (20 or 23).

In the assembly-type packaging box according to a third aspect of the present invention, an top panel (24) and a front cover panel (27) are further connected to the rear panel (13) across valley fold lines, and a front top-panel inserting tab (28 or 29) connected to a side of the front cover panel (27) across a valley fold line is inserted between the outer panel (18 or 21) and the front folding tab (14 or 15).

In the assembly-type packaging box according to a fourth aspect of the present invention, a top-panel inserting tab (25 and 26) is connected to a side of the top panel (24) across valley fold lines, and the top-panel inserting tabs (25 and 26) are positioned along inner side surfaces of the inner panels (20 and 23), respectively.

In the assembly-type packaging box according to a fifth aspect of the present invention, locking protrusions (20*a* and 23*a*) formed on edge sides of the inner panels (20 and 23) are locked, respectively, with locking holes (11*a* and 11*b*) formed on the bottom panel (11).

In the assembly-type packaging box according to a sixth aspect of the present invention, a front upper-edge panel (31) and a front inner panel (32) are further connected to the front panel (12) across valley fold lines, and the front upper-edge panel (31) and the front inner panel (32) are folded such that the front upper-edge panel (31) forms the frame having a predetermined width at the opening portion of the box body.

In the assembly-type packaging box according to a seventh aspect of the present invention, first and second folding tabs (33 to 36), which extend from sides of the outer panels (18 and 21) and the inner panels (20 and 23), respectively, are disposed to be folded between the front panel (12) and the front inner panel (32).

In the assembly-type packaging box according to an eighth aspect of the present invention, the folding protrusion (20*b* or 23*b*) is formed in an arc shape.

In the assembly-type packaging box according to a ninth aspect of the present invention, the folding protrusion (20*b* or 23*b*) is formed at a position adjacent to the upper-edge panel (19 or 22).

According to the assembly-type packaging box having the above-described configuration, a packaging box in which the frame having the predetermined width is formed on right and left opening portions by the upper-edge panel is formed by sequentially folding the right and left outer panels, the upper-edge panel, and the inner panel along the fold lines. Further, the folding protrusions each of which abuts on the rear folding tab folded between the outer panel and the inner panel are disposed on the sides of the right and left inner panels, and the folding protrusions act to effectively prevent the upper-edge panel (frame portion) from being displaced outward by abutting on the rear folding tabs.

Accordingly, it is possible to solve the problem that a gap is partially generated between the frame formed by the upper-edge panel and the top panel, and it is possible to provide the assembly-type packaging box excellent in appearance.

Further, it is possible to obtain the above-described action and effect by forming the folding protrusions on the sides of the right and left inner panels across the valley fold lines, and thus, it is possible to realize the assembly-type packaging box without causing an increase in cost.

DESCRIPTION OF THE PREFERRED EMBODIMENTS

Figure 1:
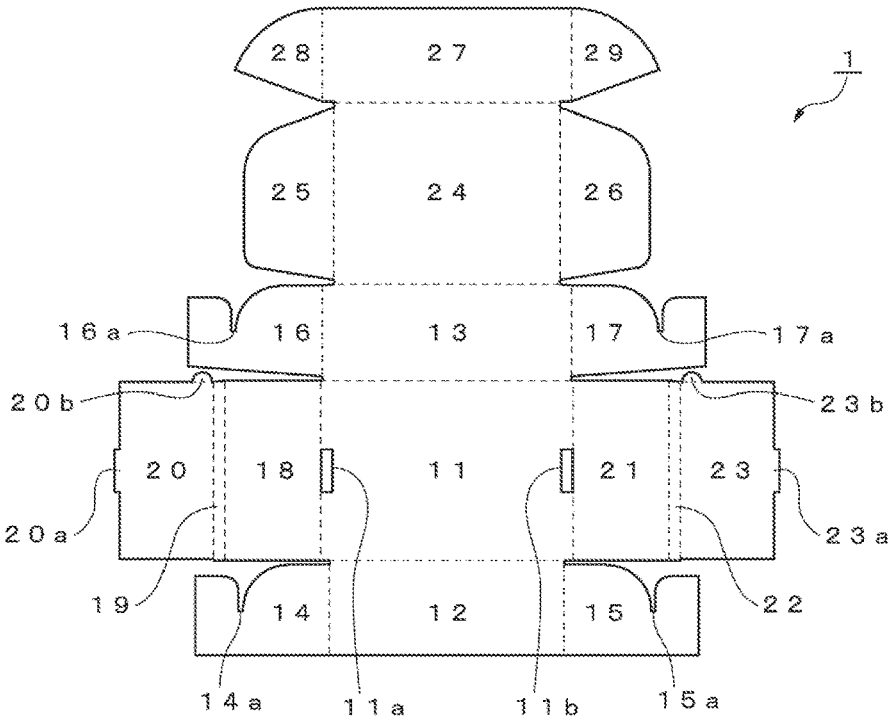
FIG. 1 is a plan view of a development sheet in a state where an assembly-type packaging box is developed in a first embodiment according to the present invention.
Figure 2:
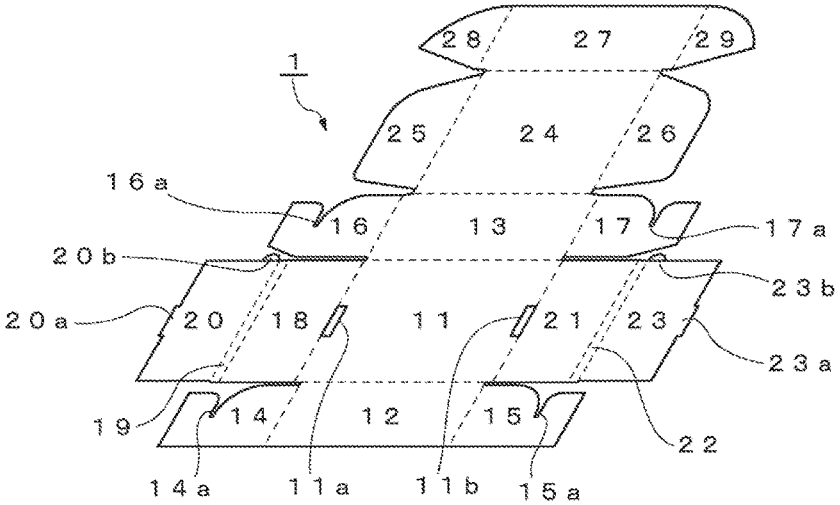
FIG. 2 is a perspective view of the development sheet illustrated in FIG. 1.

A first embodiment of an assembly-type packaging box according to the present invention will be described with reference to FIGS. 1 to 7. FIGS. 1 and 2 illustrate a development sheet 1 of an assembly-type packaging box in a front view and a perspective view, and the development sheet 1 illustrated in this example is formed by performing punching on a tab of synthetic paper. Further, the broken lines expressed in FIGS. 1 and 2 all indicate valley fold lines of 90 degrees.

Figure 13:
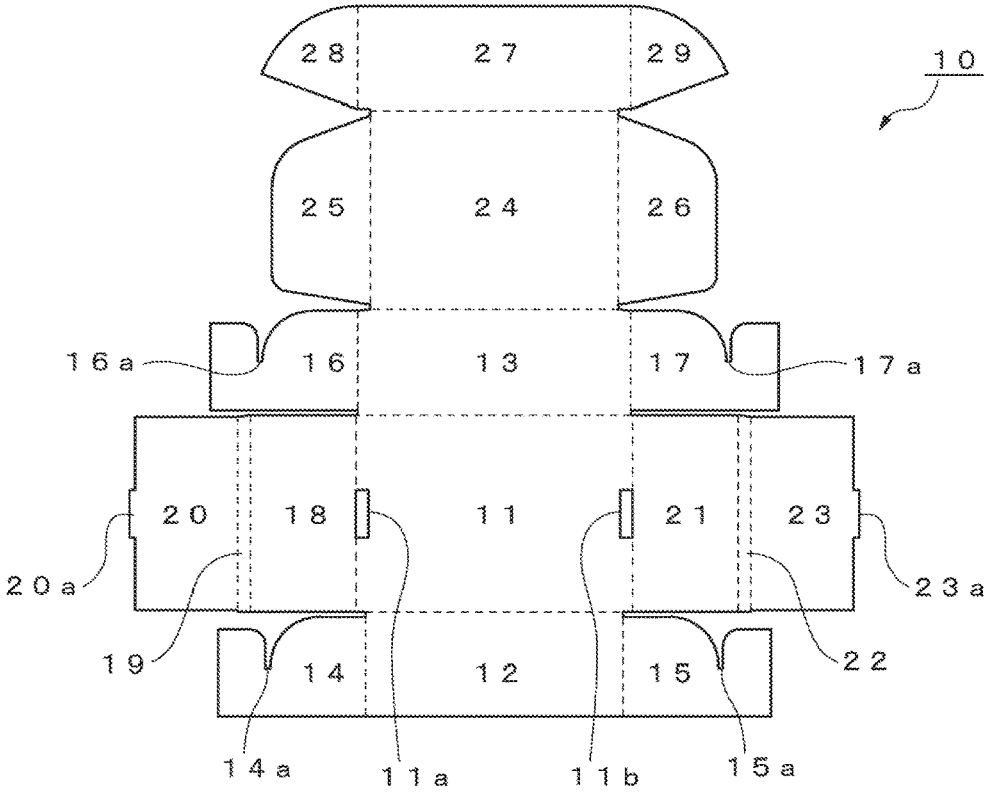
Fig. 13 Related Art
FIG. 13 is a plan view of a development sheet illustrating a state where a conventional packaging box in developed.
Figure 14:
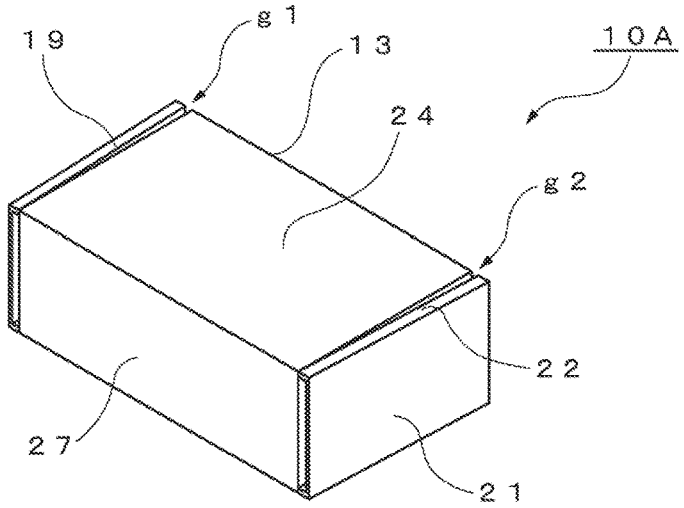
Fig. 14 Related Art
FIG. 14 is a perspective view illustrating a state where a packaging box is assembled using the development sheet illustrated in FIG. 13.

Incidentally, a difference between the development sheet 1 illustrated in FIGS. 1 and 2 and a development sheet 10 illustrated in FIG. 13, which has already been described, is that folding protrusions 20*b* and 23*b* each of which is formed in an arc shape are added on sides of a left inner panel 20 and a right inner panel 23 of the development sheet 1 illustrated in FIGS. 1 and 2.

Hereinafter, a packaging box using the development sheet 1 illustrated in FIGS. 1 and 2 will be described according to an assembling sequence illustrated in FIGS. 3 to 5.

Figure 3:
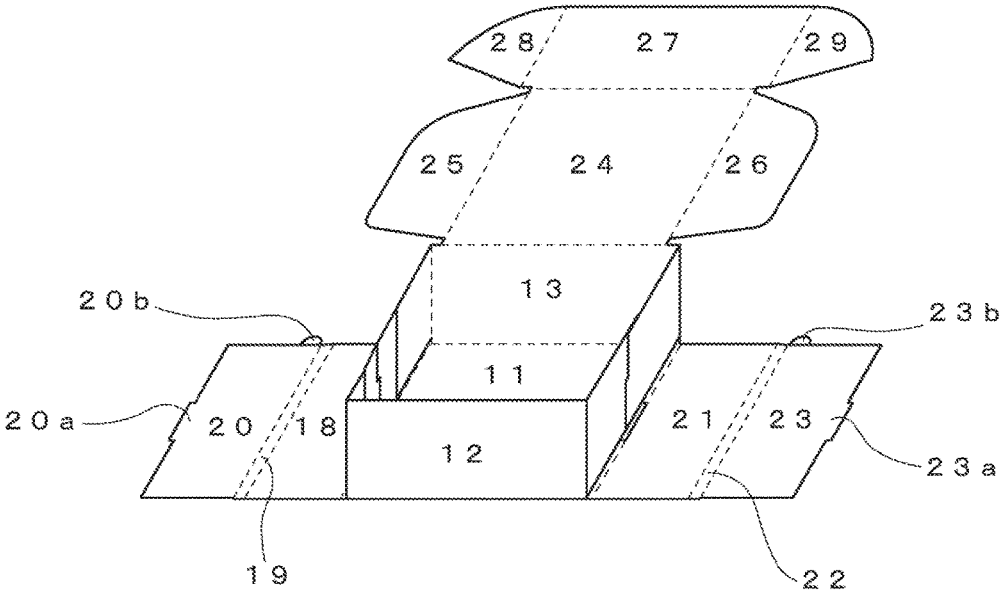
FIG. 3 is a perspective view illustrating a state where a front panel, a rear panel, and right and left folding tabs are folded in the first embodiment.

First, a front panel 12 and a rear panel 13 are folded in the state of being erected with a rectangular-shaped bottom panel 11 of the development sheet 1 as the center as illustrated in FIG. 3. Further, each of left- and right-front folding tabs 14 and 15 connected to the front panel 12 is folded along valley fold lines, and each of left- and right-rear folding tabs 16 and 17 connected to the rear panel 13 is folded along valley fold lines in the same manner.

Accordingly, slit portions of connecting slits 14*a* and 15*a* formed on the left- and right-front folding tabs 14 and 15 are directed downward. Accordingly, slit portions of connecting slits 16*a* and 17*a* formed on the left- and right-rear folding tabs 16 and 17 are directed upward.

Consequently, the connecting slit 14*a* of the left-front folding tab 14 and the connecting slit 16*a* of the left-rear folding tab 16 are inserted to each other so as to vertically intersect each other, whereby it is possible to connect both the folding tabs. Similarly, the connecting slit 15*a* of the right front folding tab 15 and the connecting slit 17*a* of the right rear folding tab 17 are inserted to each other so as to vertically intersect each other, whereby it is possible to connect both the folding tabs. FIG. 3 illustrates a state where the front, rear, left- and right-folding tabs 14, 16, 15 and 17 are connected.

Figure 4:
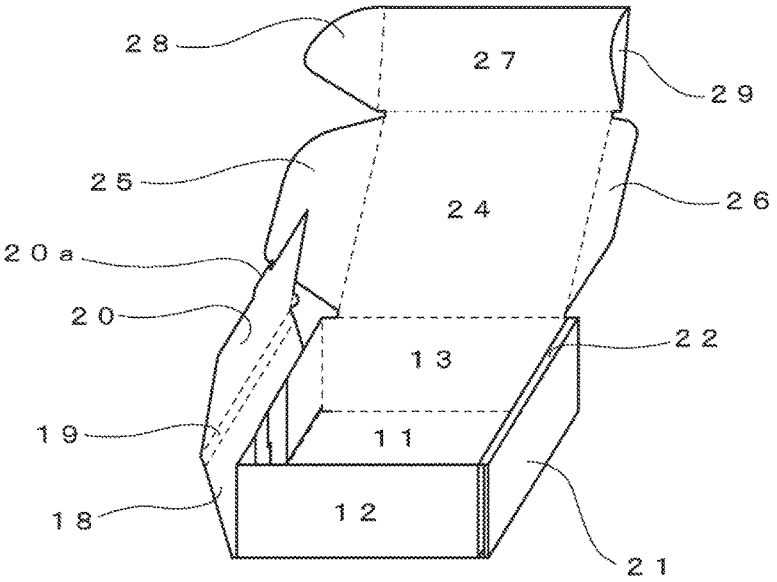
FIG. 4 is a perspective view illustrating a process of forming a frame using upper-edge panels on the right and left in the first embodiment.
Figure 5:
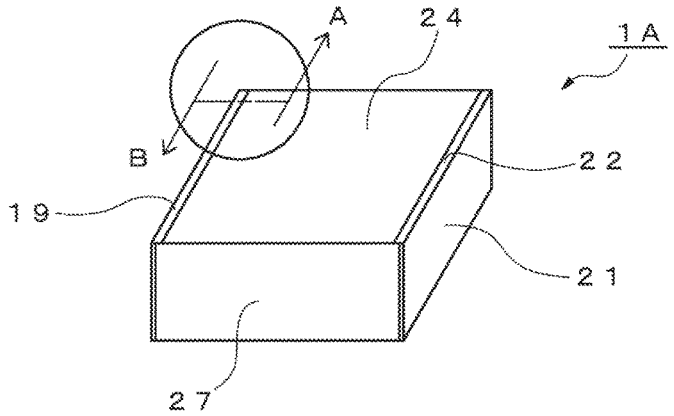
FIG. 5 is a perspective view illustrating a state where a packaging box is assembled in the first embodiment.

Subsequently, a left outer panel 18, a left upper-edge panel 19, and the left inner panel 20 are folded in order to insert a left locking protrusion 20*a* formed on the left inner panel 20 into a left locking hole 11*a* formed in the bottom panel 11 as illustrated in FIG. 4. Accordingly, the left outer panel 18, the left upper-edge panel 19, and the left inner panel 20 cover the left-front folding tab 14 and the left-rear folding tab 16 in the state of being connected to each other, and the left upper-edge panel 19 is formed as a frame on the left side of the box so as to be positioned in a frame shape.

At this time, the left folding protrusion 20*b* formed on the side of the left inner panel 20 is disposed by being folded inward so as to be positioned directly below the left upper-edge panel 19. The left folding protrusion 20*b* is formed in an arc shape across a valley fold line at a position approaching (adjacent) to the left upper-edge panel 19 on a side facing the rear side of the left inner panel 20.

Similarly, a right outer panel 21, a right upper-edge panel 22, and the right inner panel 23 are folded in order to insert a right locking protrusion 23*a* formed on the right inner panel 23 into a right locking hole 11*b* formed in the bottom panel 11.

Accordingly, the right outer panel 21, the right upper-edge panel 22, and the right inner panel 23 cover the right front folding tab 15 and the right rear folding tab 17 in the state of being connected to each other, and the right upper-edge panel 22 is formed as a frame on the right side of the box so as to be positioned in a frame shape.

At this time, similarly, the right folding protrusion 23*b* formed on the side of the right inner panel 23 is disposed by being folded inward so as to be positioned directly below the right upper-edge panel 22. Incidentally, the right folding protrusion 23*b* is formed in an arc shape across a valley fold line at a position approaching (adjacent) to the right upper-edge panel 22 at a side facing the rear side of the right inner panel 23.

Although the example shown in FIG. 4 illustrates the right outer panel 21, the right upper-edge panel 22, and the right inner panel 23 are folded beforehand, it is obvious that there is no problem even if the folding order of the right and left is reversed.

Further, a left top-panel inserting tab 25 and a right top-panel inserting tab 26 are folded with respect to the top panel 24 to fold the top panel 24 with respect to the rear panel 13, whereby the left top-panel inserting tab 25 and the right top-panel inserting tab 26 are accommodated in a box. That is, the left top-panel inserting tab 25 is turned into the state of being in contact with the left inner panel 20, and the right top-panel inserting tab 26 is turned into the state of being in contact with the right inner panel 23.

Accordingly, the left upper-edge panel 19 and the right upper-edge panel 22 are turned into the state of being positioned on both the right and left sides of the closed top panel 24, respectively, in a frame shape.

Subsequently, each of the left front-panel inserting tab 28 and the right front-panel inserting tab 29 is folded with respect to the front cover panel 27, and the left front-panel inserting tab 28 is inserted into a gap between the left outer panel 18 and the left-front folding tab 14. Similarly, the right front-panel inserting tab 29 is inserted into a gap between the right outer panel 21 and the right front folding tab 15, whereby it is possible to assemble the cuboid-shaped packaging box 1A illustrated in FIG. 5.

Figure 6:
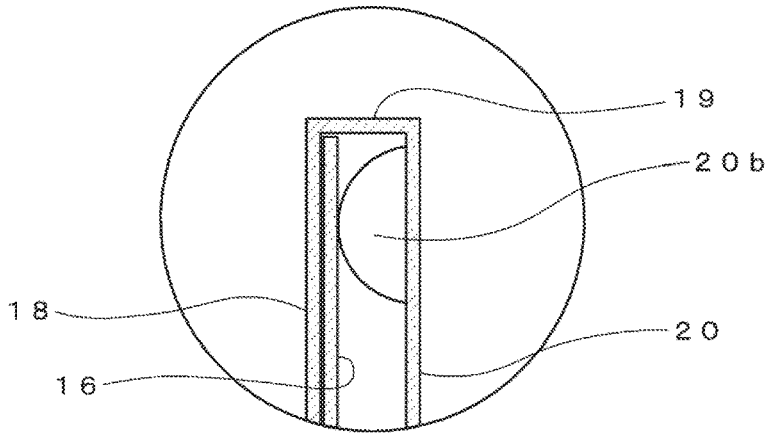
FIG. 6 is an enlarged cross-sectional view of a folding protrusion portion as seen in a direction of an arrow A from a cut portion indicated by a chain line in FIG. 5.
Figure 7:
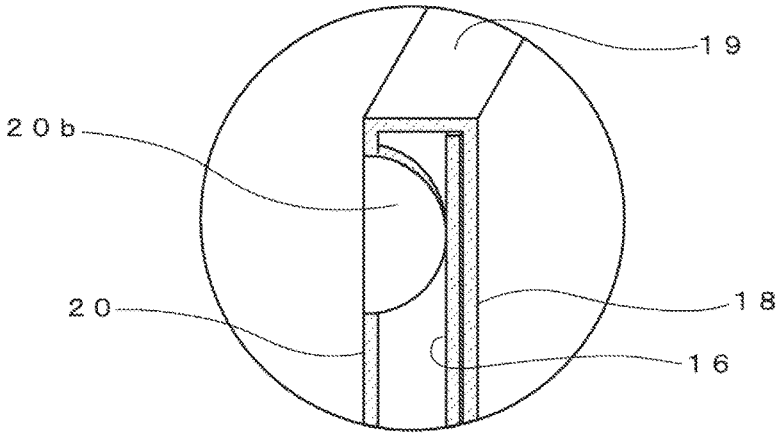
FIG. 7 is an enlarged cross-sectional view of the folding protrusion portion as seen in a direction of an arrow B from the cut portion indicated by the chain line in FIG. 5.

FIGS. 6 and 7 illustrate the action of the left folding protrusion 20*b* formed on the side of the left inner panel 20.

As described above, the left folding protrusion 20*b* constitutes the arc-shaped small protrusion and is folded along the valley fold line directly below the left upper-edge panel 19, and an arc-shaped distal end portion thereof abuts on the left-rear folding tab 16. In addition, the abutment position of the left folding protrusion 20*b* on the left-rear folding tab 16 is the position approaching to the rear panel 13 (the position adjacent to the top panel 24 of the rear panel 13, that is, a position at a left upper corner of the rear panel 13 in FIGS. 3 and 4, thus, movement of the left-rear folding tab 16 in a width direction (movement toward the outside of the box) is effectively prevented.

Thus, the left inner panel 20 in which the left folding protrusion 20*b* is formed and the left upper-edge panel 19 connected thereto are prevented from being displaced toward the outside of the box. As a result, the generation of the gap between the left upper-edge panel 19 and the top panel 24 forming the frame is prevented.

Although the description has been given regarding the action of the left folding protrusion 20*b*, the right folding protrusion 23*b* is at a laterally symmetric position with the left folding protrusion 20*b*, and accordingly, the same action and effect may be obtained with the right folding protrusion 23*b*.

That is, the abutment position of the right folding protrusion 23*b* on the right rear folding tab 17 is the position approaching to the rear panel 13 (the position adjacent to the top panel 24 of the rear panel 13, that is, a position at a right upper corner of the rear panel 13 in FIGS. 3 and 4), thus, movement of the right rear folding tab 17 in a width direction (movement toward the outside of the box) is effectively prevented.

FIGS. 8 to 12 illustrate a second embodiment of the assembly-type packaging box.

Although the cuboid-shaped packaging box that is long in the width direction is formed in the above-described first embodiment, the packaging box formed in a cuboid shape that is long in the depth direction is formed in the second embodiment.

Further, the second embodiment is configured such that a frame is also formed by an upper-edge panel at an opening portion on a front surface side of a box in addition to right and left frames formed by an upper-edge panel at right and left opening portions of the box.

Figure 8:
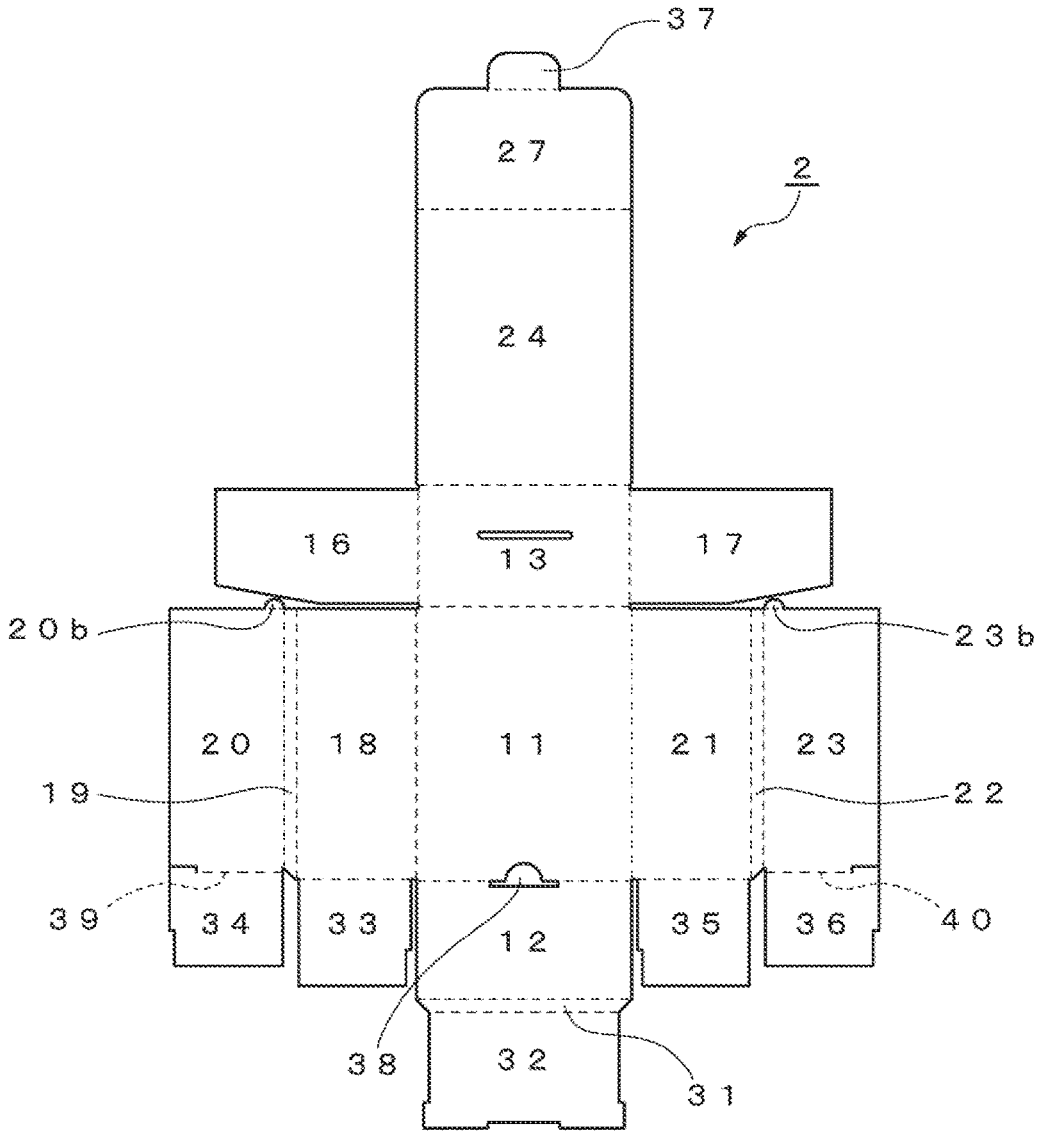
FIG. 8 is a plan view of a development sheet in a state where an assembly-type packaging box is developed in a second embodiment.
Figure 9:
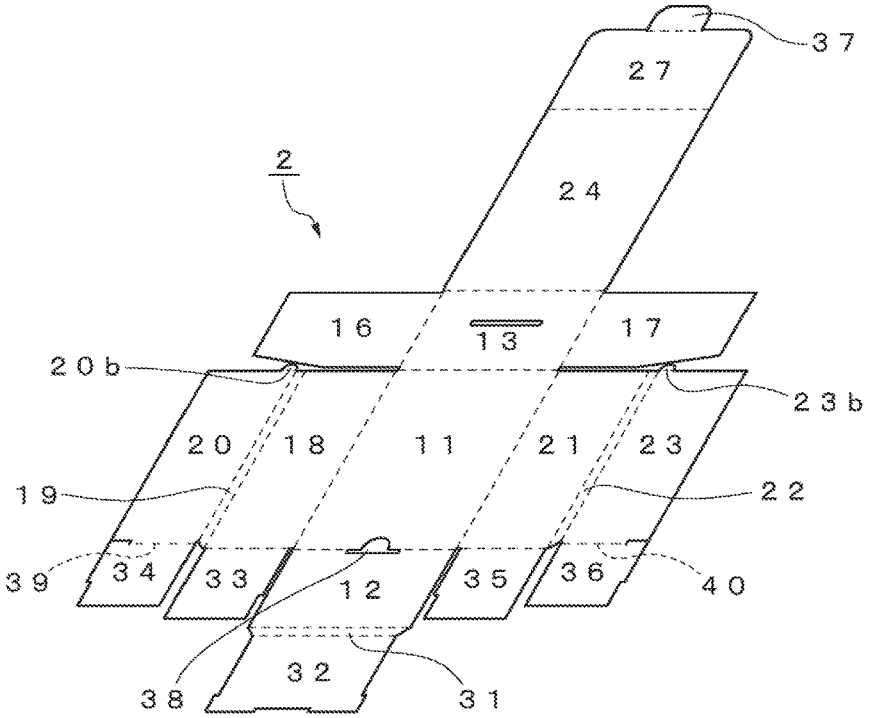
FIG. 9 is a perspective view of the development sheet illustrated in FIG. 8.

FIGS. 8 and 9 illustrate a development sheet 2 of the assembly-type packaging box in a front view and a perspective view, and the development sheet 2 illustrated in this example is formed by performing punching on a tab of synthetic paper. Further, broken lines denoted by reference numerals 39 and 40 among broken lines expressed in FIGS. 8 and 9 are mountain fold lines of 90 degrees, and the other broken lines without reference numerals indicate valley fold lines of 90 degrees.

Incidentally, parts having the same functions as the portions illustrated in FIGS. 1 to 7, which have already been described, are denoted by the same reference numerals in FIGS. 8 to 12.

A description will be given according to an assembly sequence illustrated in FIGS. 10 to 12.

Figure 10:
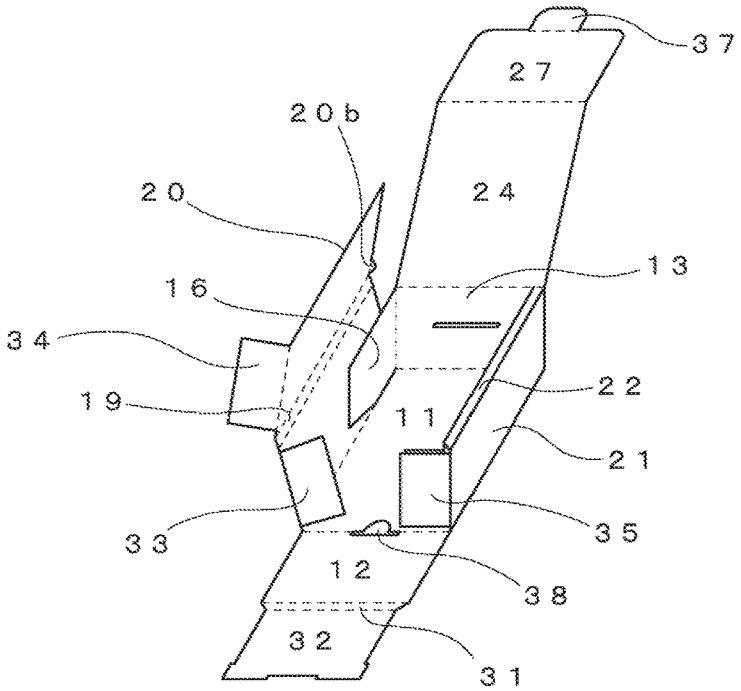
FIG. 10 is a perspective view illustrating a process of forming a frame using right and left upper-edge panels in the second embodiment.

As illustrated in FIG. 10, the rear panel 13 is folded into the state of being erected with the rectangular-shaped bottom panel 11 of the development sheet 2 as the center. Further, each of the left and right rear folding tabs 16 and 17 connected to the rear panel 13 is folded across the valley fold line.

Subsequently, the left outer panel 18, the left upper-edge panel 19, and the left inner panel 20 are folded in order. At this time, a front left second folding tab 34 formed on a side of the left inner panel 20 is folded along the mountain fold line 39. Accordingly, the left outer panel 18, the left upper-edge panel 19 and the left inner panel 20 cover the left-rear folding tab 16, and the left upper-edge panel 19 is formed on the left side of the box so as to be positioned in a frame shape.

At this time, the left folding protrusion 20*b* formed on the side of the left inner panel 20 is disposed by being folded inward so as to be positioned directly below the left upper-edge panel 19. The left folding protrusion 20*b* is formed in an arc shape across a valley fold line at a position approaching (adjacent) to the left upper-edge panel 19 on a side facing the rear side of the left inner panel 20.

Similarly, the right outer panel 21, the right upper-edge panel 22, and the right inner panel 23 are folded in order. At this time, a front right second folding tab 36 formed on a side of the right inner panel 23 is folded across the mountain fold line 40. Accordingly, the right upper-edge panel 22 is formed on the right side of the box so as to be positioned in a frame shape.

At this time, similarly, the right folding protrusion 23*b* formed on the side of the right inner panel 23 is disposed by being folded inward so as to be positioned directly below the right upper-edge panel 22. Incidentally, the right folding protrusion 23*b* is formed in an arc shape across a valley fold line at a position approaching (adjacent) to the right upper-edge panel 22 at a side facing the rear side of the right inner panel 23.

Although the example shown in FIG. 10 illustrates the right outer panel 21, the right upper-edge panel 22, and the right inner panel 23 are folded beforehand, there is no problem even if the folding order of the right and left is reversed.

Subsequently, a front left first folding tab 33 and a front right first folding tab 35 are folded along the valley fold lines so that a state where the front left second folding tab 34 is superimposed on the left first folding tab 33 is formed. In addition, a state where the front right second folding tab 36 is superimposed on the front right first folding tab 35 is formed.

In this state, the front panel 12, the front upper-edge panel 31, and the front inner panel 32 are folded in order. Accordingly, the left and right first folding tabs 33 and 35 and the left and right second folding tabs 34 and 36 are covered by the front panel 12, the front upper-edge panel 31, and the front inner panel 32, and the box is formed such that the front upper-edge panel 31 is positioned in a frame shape at the front side of the box as shown in FIG. 11. Therefore, the packaging box in which the frame having a predetermined width is formed on opening edges on the right and left sides and the front side of the box.

Figure 11:
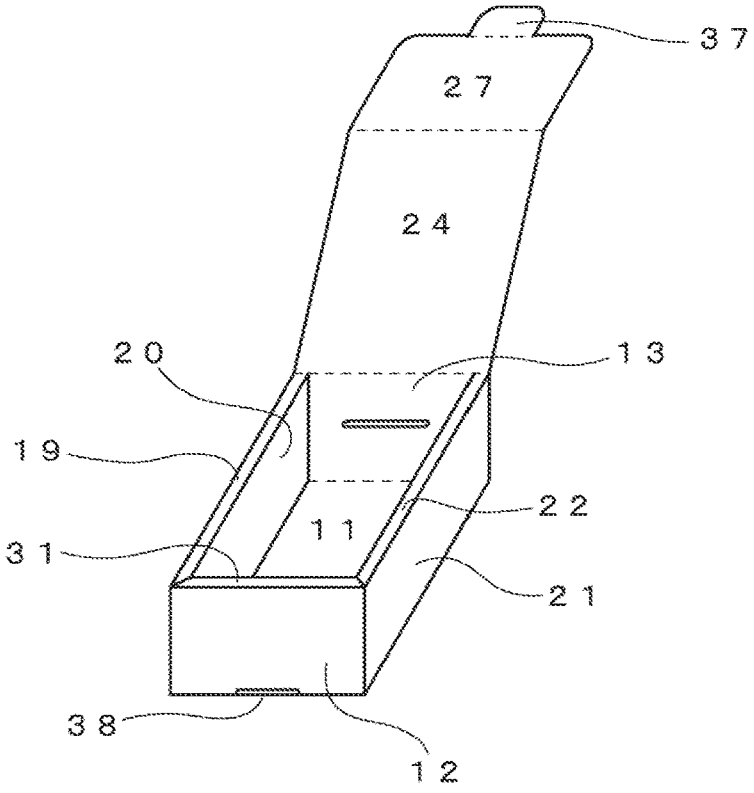
FIG. 11 is a perspective view illustrating a process of forming a frame using a front upper-edge panel in the second embodiment.
Figure 12:
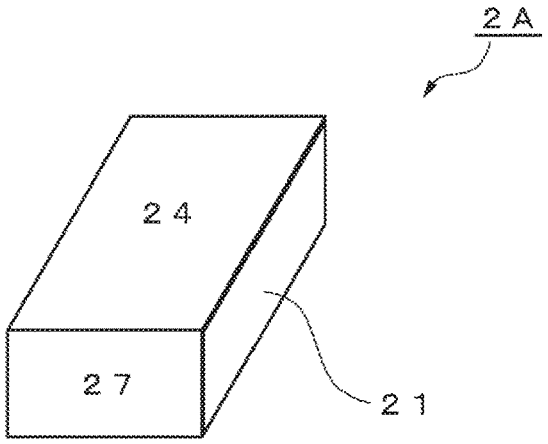
FIG. 12 is a perspective view illustrating a state where a packaging box is assembled in the second embodiment.

In the state shown in FIG. 11, it is possible to assemble a cuboid-shaped packaging box 2A that is long in the depth direction, shown in FIG. 12, by sequentially folding the top panel 24 and the front cover panel 27 such that a locking tab 37 formed at an end side of the front cover panel 27 is inserted into a locking tab insertion hole 38 formed at a boundary between the bottom panel 11 and the front panel 12.

Incidentally, each action of the left folding protrusion 20*b* formed on the left inner panel 20 and the right folding protrusion 23*b* formed on the right inner panel 23 in the second embodiment are the same as those of the first embodiment, which has been described with reference to FIGS. 6 and 7, and it is also possible to obtain the same action and effect in this second embodiment.

Although both the left and right folding protrusions 20*b* and 23*b* are formed in the arc shape in the above-described embodiments, any shape such as a trapezoidal shape and a polygonal shape can be adopted for those protrusions.

What is claimed is:

1. An assembly-type packaging box, comprising:

a bottom panel, a front panel and a rear panel erecting along valley fold lines respectively in front of and behind the bottom panel, and outer panels, upper-edge panels, and inner panels which are sequentially connected to right and left of the bottom panel across valley fold lines, and which are sequentially folded such that a rear folding tab extending from a side of the rear panel is folded in between the outer panel and the inner panel and the upper-edge panels form a frame having a predetermined width at an opening portion, front folding tabs extending from sides of the front panel, each being folded in between the outer panel and the inner panel, the front folding tab and the rear folding tab being connected between the outer panel and the inner panel, an top panel and a front cover panel connected to the rear panel across valley fold lines, and front-panel inserting tabs connected to sides of the front cover panel across valley fold lines, each being inserted between the outer panel and the front folding tab, wherein folding protrusions, each fixing a position of the upper-edge panel by abutting on the rear folding tab folded in between the outer panel and the inner panel, are formed only on rear sides of the inner panels.

2. The assembly-type packaging box according to claim 1, wherein top inserting tabs are connected to sides of the top panel across valley fold lines, and the top-panel inserting tabs are positioned along inner side surfaces of the inner panels, respectively.

3. The assembly-type packaging box according to claim 1, wherein locking protrusions formed on edge sides of the inner panels are respectively locked with locking holes formed on the bottom panel.

4. The assembly-type packaging box according to claim 1, wherein the folding protrusion is formed in an arc shape.

5. The assembly-type packaging box according to claim 1, wherein the folding protrusion is formed at a position adjacent to the upper-edge panel.

6. The assembly-type packaging box according to claim 1, wherein the folding protrusions are not formed on sides that the front folding tabs are present.

7. The assembly-type packaging box according to claim 6, wherein each of the folding protrusions has an arc shape, and an outermost part of the arc shape abuts on the rear folding tab.

* * * * *